US006470542B1

(12) United States Patent
Giannini

(10) Patent No.: US 6,470,542 B1
(45) Date of Patent: Oct. 29, 2002

(54) DEVICE AND METHOD FOR TASSELS

(76) Inventor: Larry P. Giannini, 1166 Shafter Ave., Suite C, San Francisco, CA (US) 94124

( * ) Notice: Subject to any disclaimer, the term of this patent is extended or adjusted under 35 U.S.C. 154(b) by 0 days.

(21) Appl. No.: 09/634,621

(22) Filed: Aug. 5, 2000

(51) Int. Cl.[7] ..... A43C 7/00

(52) U.S. Cl. ..... 24/712.1; 24/714.6; 24/715.5; 24/129 A; 24/136 L

(58) Field of Search ..... 24/713.1, 713.6, 24/714.6, 715.1, 715.4, 715.5, 715.6, 122.6, 129 A, 132 R, 487, 543

(56) References Cited

U.S. PATENT DOCUMENTS

| | | | | | |
|---|---|---|---|---|---|
| 690,003 | A | | 12/1901 | Altman | |
| 875,560 | A | | 12/1907 | Vaughan | |
| 1,164,810 | A | | 12/1915 | Hammond | |
| 1,825,074 | A | * | 9/1931 | Knapp | 24/129 R |
| 2,112,100 | A | * | 3/1938 | King | 24/715.5 |
| 2,596,635 | A | * | 5/1952 | Wolfe | 24/132 R |
| 3,812,603 | A | | 5/1974 | Goodman | |
| 4,317,262 | A | * | 3/1982 | Wells, Jr. | 24/16 PB |
| 4,637,097 | A | * | 1/1987 | Secord | 24/16 PB |
| 4,766,682 | A | | 8/1988 | Malloy, III | |
| 4,782,560 | A | * | 11/1988 | Keller | 24/136 L |
| 4,967,454 | A | * | 11/1990 | Elieff | 24/712.1 |
| 5,109,578 | A | | 5/1992 | Cox | |
| 5,219,624 | A | | 6/1993 | Kiapos et al. | |
| 5,351,367 | A | * | 10/1994 | Kennedy et al. | 24/129 R |
| 5,367,750 | A | * | 11/1994 | Ward | 24/16 PB |
| 5,619,778 | A | * | 4/1997 | Sloot | 24/712.4 |
| D390,350 | S | | 2/1998 | Menelly | |
| 5,832,574 | A | * | 11/1998 | Shin | 24/712.1 |
| 5,867,925 | A | | 2/1999 | Fattori | |
| 6,055,714 | A | * | 5/2000 | Sproul | 24/715.5 |

* cited by examiner

*Primary Examiner*—Victor Sakran
(74) *Attorney, Agent, or Firm*—Ray K. Shahani, Esq.

(57) ABSTRACT

A method and apparatus of preserving and protecting decorative tassels after they have become unsightly from wearing of an item, or to prevent their becoming so, particularly on shoes to which they are attached. Typically, one or more tassels are made up of strands of leather or synthetic leather extending integrally side-by-side from a stem base attached to the shoe. The method and apparatus comprises of arranging or rearranging and encasing the strands in a clamshell having an upper portion and a lower portion and snap lock mechanism with integrally molded hinge, thereby pressing the strands between the locked clamp and reviving them to or maintaining them in their original aesthetic appearance economically and conveniently.

15 Claims, 8 Drawing Sheets

DEVICE AND METHOD FOR TASSELS

FIELD OF THE INVENTION

The present invention relates to the method and apparatus of a preserving and protecting tassels. More particularly, the present invention relates to a shoe tassel retainer for shoes having at least one tassel, such as overlying an arch of the shoe. The invention is concerned with an apparatus to maintain the aesthetic appearance of the shoes or other items by placing and holding the component strands of decorative tassels into their original conditions after displacement by use of the shoes or other items to which the tassels are attached.

BACKGROUND OF THE INVENTION

It has long been fashionable for both men and women to wear shoes equipped with tassels, which are normally made up of rectilinear strands of leather arranged side-by-side in substantially cylindrical formation. When such shoes are new and boxed or are otherwise placed in stores for display, the strands of such tassels are straight and neatly punched together. However, normal use of the shoes carrying the tassels usually disarranges the component strands in an unsightly manner. Prolonged and improper storage may also render the tassels deshaped. Heretofore, there is no effective way for the wearer to maintain the appearance of the tassels.

Various boots have been made to overlie shoes in inclement weather to protect the shoes. Shoe accessory clips having a pair of overlapped, toothed jaws normally held together by spring action (Spring Clip design) and operable by the user for receiving a tassel between the spring pressed jaws. It is also proposed that merely clipping the device onto an unruly tassel and leaving the receiving jaws of the clip under spring pressure overnight will "tame" the unsightly tassel. Another traditional way of straightening the tassels is by winding a rubber band over the rearranged tassels. Such a method is patently weak and ineffective.

One prior art, U.S. Pat. No. 3,812,603 issued to Goodman describes a detachable spiked shoe protective cover that increases footing on hard surfaces and prevents injury to other surfaces for wearers of spiked shoes such as golf shoes or track shoes.

Another prior art, U.S. Pat. No. 690,003 issued to Altman describes a detachable shoelace protector having a shield overlying the shoelaces of a shoe and held in place by a strap that passes through the shoe instep and connects to the other end of the strap by an eyelet/tab connector. Hooks are affixed to the upper inside end of the shield and engage the upper edge of the shoe or the laces. The Altman protector serves to completely overlie and protect the shoelaces and prevent them form becoming untied. If used with buttoned shoes, it serves solely as ornamentation.

A further prior art, U.S. Pat. No. 4,766,682 issued to Malloy teaches a removable lace cover strap placed about the instep of laced footwear, usually athletic shoes, to prevent the laces from becoming untied. This device also serves for decorative purposes. A strap is provided with a width about equal to the instep and a length just sufficient to allow overlapping of the strap's opposite ends. A hook type fastener, such as a Velcro fastener, may be used to fasten the strap's opposite ends together during the athletic performance of the wearer.

A further prior art, U.S. Pat. No. 6,055,714 issued to Sproul discloses a method of renewing decorative tassels after they have become unsightly from wearing of an item to which they are attached. The method comprises encasing the tassel, as straightened and rearranged, in a tube length of heat-shrink material; applying moisture to the strands of the tassel; heating the heat-shrink tube along its length to shrink it tightly against the tassel as straightened and rearranged, so as to press it into renewed conditions; and removing the shrunken tube from the renewed tassel substantially without disturbing the straightened and rearranged strands thereof One prior art, U.S. Pat. No. 875,560 issued to Vaughan discloses a shoe protector designed to protect a shoe against abrasion and cuts at the shank and instep when worn by miners, laborers on railways and other places where shovels or spades are used.

A further prior art, U.S. Pat. No. 1,164,810 issued to Hammond describes a toe brake for use by coasters (or sled riders) that is easily attachable to a shoe and which allows the coaster to guide and brake the sled without damaging the coaster's shoe. The toe brake is positioned and retained on the centerline of the without presenting a fastening strap in a position to be stepped on or readily become worn out. The braking means consists of and upwardly inclined, pointed member in line with the shank at the toe end.

The prior art does not teach a device to maintain tassels at or near their original positions to restore and maintain the attractive appearance of the shoes. Thus, it would be advantageous to have a separate portion to overly the tassels allowing a separate of the tassels.

Numerous other advantages and features of the present invention will become readily apparent from the following detailed description of the invention and the embodiments thereof, from the claims and from the accompanying drawings.

ADVANTAGES AND SUMMARY OF THE INVENTION

Accordingly, it is an object of the present invention to provide a tassel preserver specifically designed to retain or reform the tassels to their original, desired positions.

Another object of this invention is to provide a shoe tassel device to allow exertion of just adequate pressure against the tassels to reform, but not deform, them.

In making the present invention, it is a principal object to provide an apparatus and method whereby the repair shop or the user himself, or herself, can renew or maintain shoe tassels quickly and economically.

It is the advantage of the present invention that it helps preserve not only shoe-trimming tassels but also tassels attached to other articles of use for ornamental purposes.

Another advantage of the present invention is the safe storage of the tassels so that they are not depressed or entangled over the course of time.

In the achievement of this objective the present invention makes the use of the clamshell concept, which eliminates the paddles (spring clip design) in favor of a hinged top cover upper portion, which is secured by using a snap fit feature. Release is accomplished by incorporating a flexible finger that deflects under a slight finger pressure. A molded living hinge is incorporated into the device eliminating need for post molding assembly and providing resistance that aids in the snap fit action. The clamshell design minimizes the use of plastic material over the spring clip design, thus reducing material cost. It will be less complex to mold the integral hinge. This design also eliminates the necessity to use an additional spring to provide compression during closure as the snap fit provides this function. A customer specific logo may be molded in-situ using an exchangeable mold insert.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENT

Figure 1:
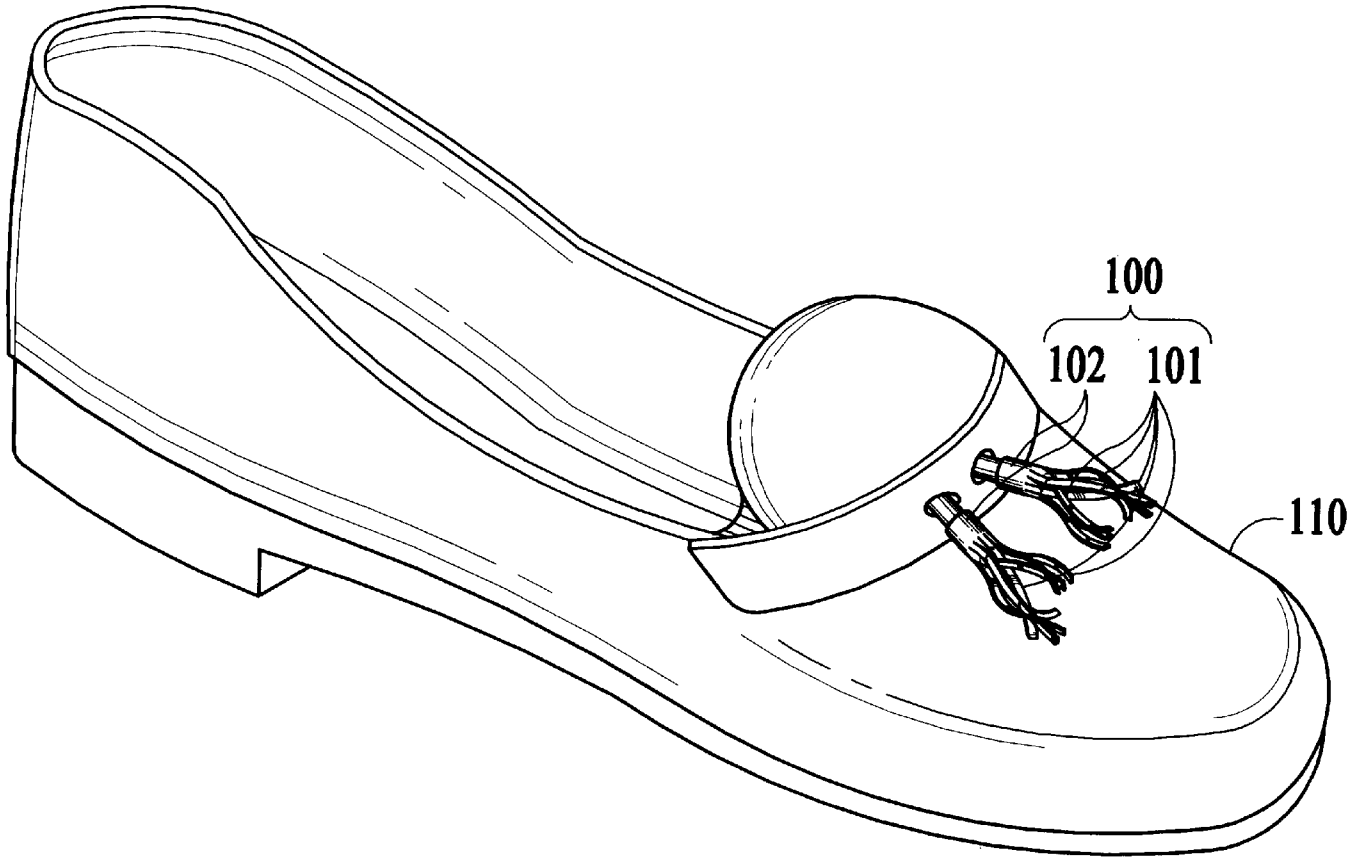
FIG. 1 (PRIOR ART)
FIG. 1 represents a pictorial view of a usual casual or sport shoe equipped with a pair of typical, shoe-trimming tassels, the view looking toward the vamp portion of the shoe after the shoe has been worn and the component strands of the respective tassels have been disarranged in an unsightly manner.

It will be understood that while numerous preferred embodiments of the present invention are presented herein, numerous of the individual elements and functional aspects of the embodiments are similar. Therefore, it will be understood that structural elements of the numerous apparatus disclosed herein having similar or identical function may have like reference numerals associated therewith.

FIG. 1 of the drawing shows typical, paired tassels 100, on a shoe 110, each tassel being cut from leather or a leather substitute into strands 101 extending integrally from a base stem portion 102 to which they are attached in various ways with or without additional tassel structure (not shown) depending upon the particular make of the shoe and the tassels thereof. As shown, the strands 101 have become disarranged and bent out of their original, side-by-side, cylindrical tassel shape resulting from use of the shoe 110 to which they are attached as decorative trim. It should be noted that the shoe 110 and the tassels 100, with its strands 101 extending from its base stem 102, are structurally part of the prior art and that the present invention proposes a device to preserve the tassels in their original shape.

Figure 2:
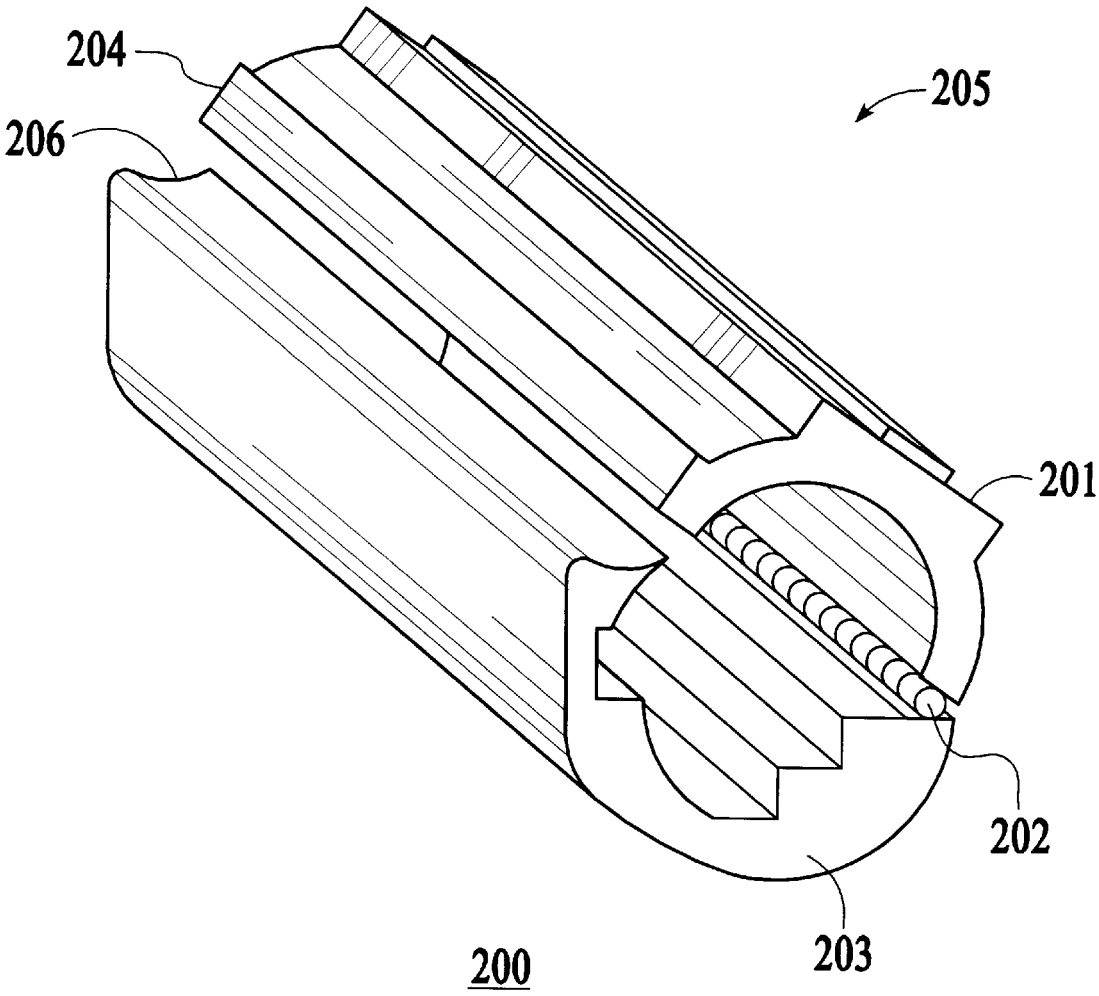
FIG. 2 is a representative perspective view of a preferred embodiment of the tassel device in an open position.

FIG. 2 is the representative view of the tassel preserving device 200 in an open position. The device 200 is an open-ended tubular portion, hereto referred as clamshell 205, hollow from inside, and designed in variable sizes to receive the tassel 100. The clamshell 205 comprises of an upper portion 201, and a lower portion 203. A flexible hinge 202 connects the upper portion 201 with the lower portion 203. In a preferred embodiment of the clamshell 205, the hinge 202 may be integrally molded with the upper portion 201 and the lower portion 203, to join the upper portion 201 and the lower base portion 203 of the clamshell 205. However, the hinge 202 may be separately constructed to serve the same purpose. A clamp 204 locks the tassel strands 101 in the clamshell 205 along the length of the clamshell 205. A snap fit feature secures the locking and presses the tassel strands 101. A release finger 206 is provided to unlock the tassel strands 101 that are encased in the clamshell 205 for pressing. The clamshell 205 is made up of any of a number of conventional materials such as plastic, rubber, metal, fiberglass or other composite materials.

Figure 3:
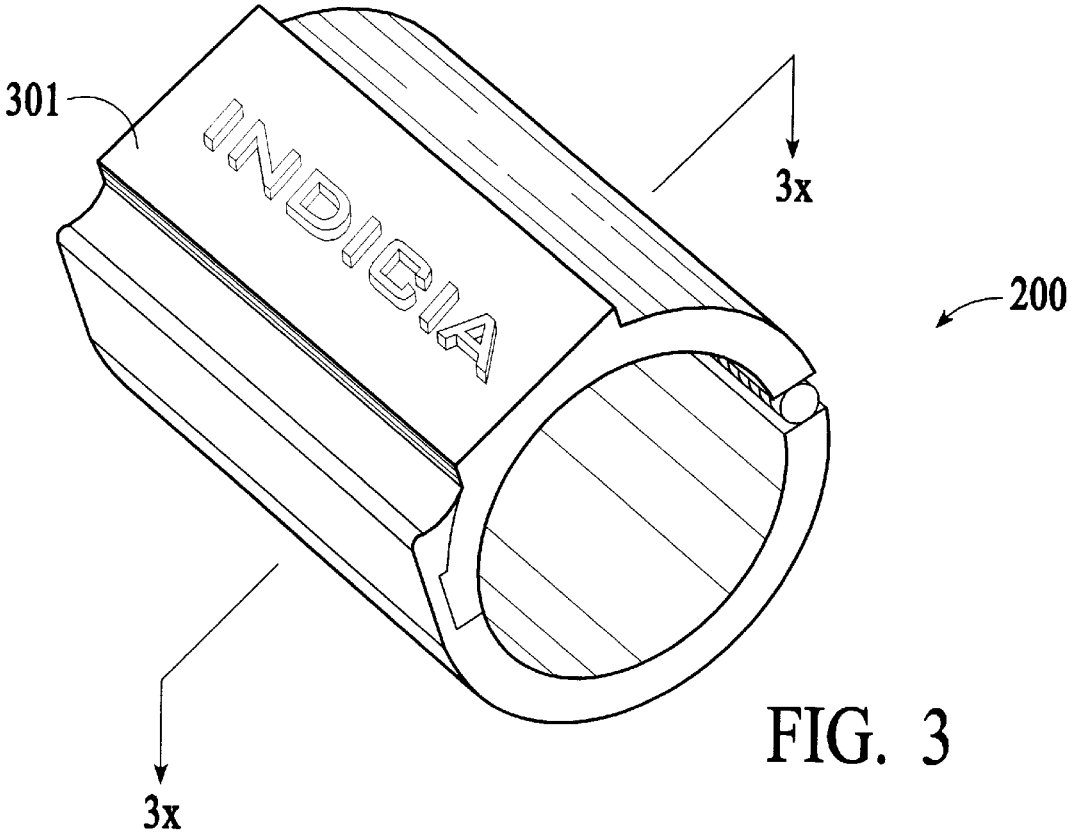
FIG. 3 is a perspective view of the tassel device of FIG. 2 showing a logo.

FIG. 3 is a representative perspective view of the device 200 of FIG. 2 showing a logo 301 for promotional purposes. A customer specific logo 301 may be molded in-situ using an exchangeable mold insert. In the alternative, a logo 301 may be embossed on the clamshell 205 of the device 200.

Figure 3A:
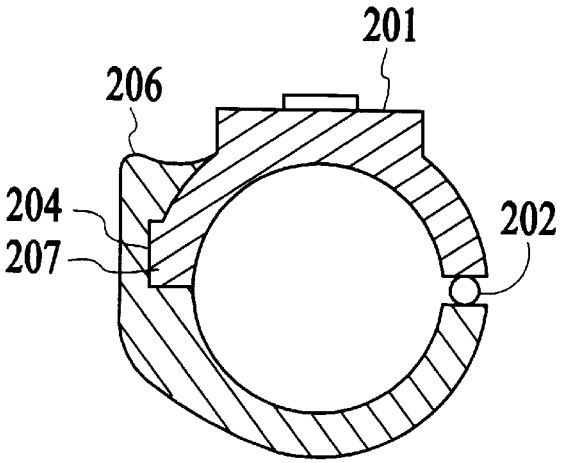
FIG. 3A is a representative cross-section view of the tassel device of FIG. 3 in a closed position.

FIG. 3A is the representative cross-section 3*x*—3*x* of the device 200 of FIG. 2. in a closed position. The snap fit mechanism secures the lock. The molded living hinge 202 provides the resistance that aids in the snap fit action. The clamp 204 on the upper portion 201 locks in well with a groove 208 in the lower portion 203 of the clamshell 205. Release is accomplished by incorporating a flexible release finger 206 that deflects under slight finger pressure.

Figure 3B:
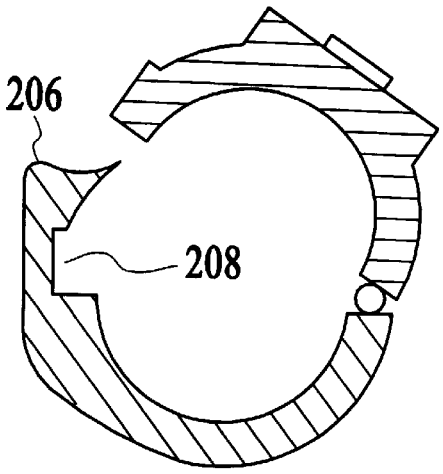
FIG. 3B is a representative cross-section view of the tassel device of FIG. 3 in an open position.

FIG. 3B is the representative cross-section view of the tassel protecting device of FIG. 2. in an open position. The hinge 202 allows the upper portion 201 to remain open. While in open position, the clamshell 205 permits the tassel to be inserted into it. After the tassel 100 is housed in the clamshell 205, the upper portion is pressed down and by virtue of the snap fit action caused by the hinge 202, the clamp 204 locks in the protrusion 208 of the lower portion 203 and applies pressure on the inserted tassel 100. The clamp 204 has a single, double or a triple click lock.

Figure 4A:
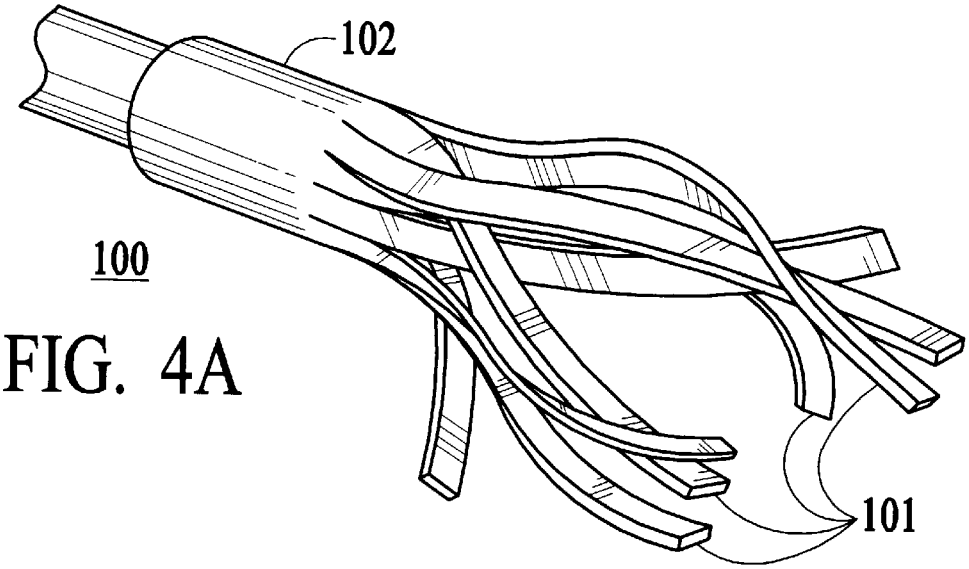
FIG. 4A is an enlarged fragmentary view of one of the pair of tassels of the shoe of FIG. 1.

FIG. 4A is an enlarged fragmentary view of one of the pair of tassels 100 of the shoe 110 of FIG. 1. The tassel 100, as shown, has its strands 101 in an unruly and disarranged state caused by an extended use. The device 200 of FIG. 2 is designed to avoid such a condition of the tassels. The tassel 100 is encased by the device 200 before sale, during storage, and after the shoe has been used. The tassel 100 gets pressed and straightened, and its aesthetic appearance maintained. The tassel 100 is ready and in shape for the next use.

Figure 4B:
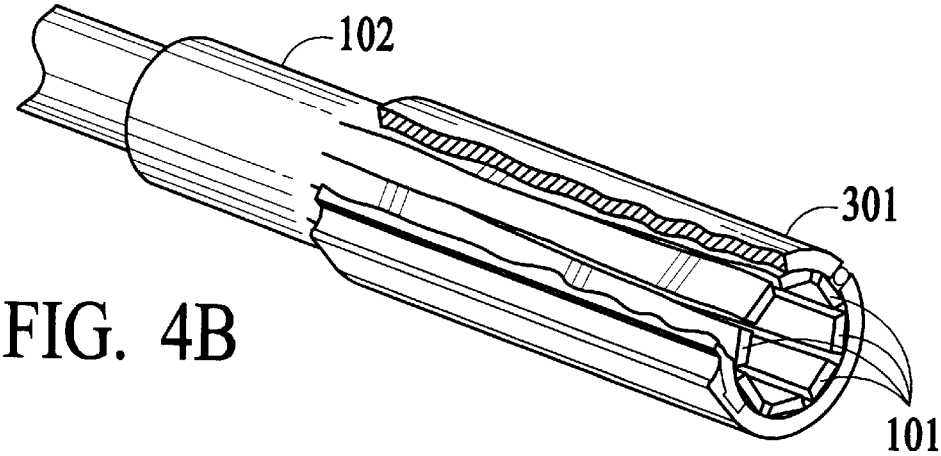
FIG. 4B shows the disarranged strands of the tassel of FIG. 4A bunched, rearranged and tucked into an appropriate length and diameter of the tassel preserving device for pressing of the encased tassels.

FIG. 4B shows the method by which the tassel 100 is inserted into the device 200. The unruly tassel strands 101 are first arranged and disentangled into a bunch of linear strands and then carefully tucked into the clamshell 205 by opening the upper portion 201. The upper portion 201 is then snapped to allow the strands 101 of the tassel 100 to get pressed and straightened under pressure.

Figure 4C:
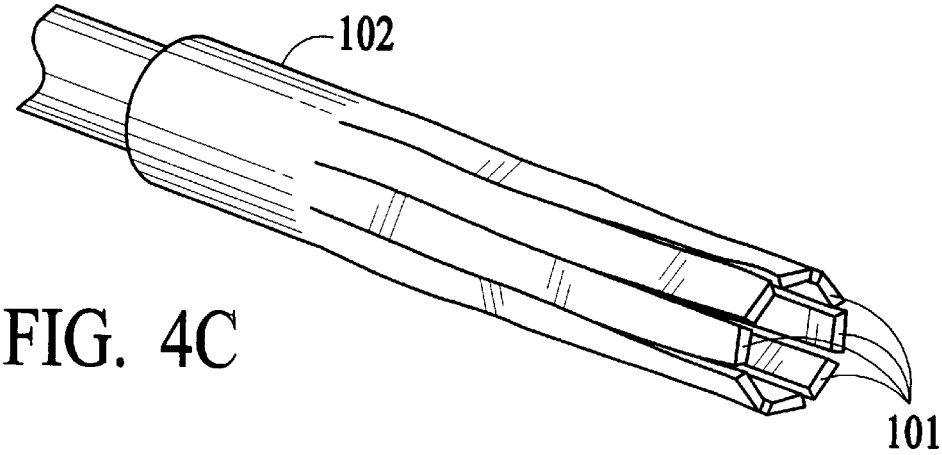
FIG. 4C is a perspective view of pressed and reformed tassel of FIG. 4A after having undergone the method and/or after use of the device of the present invention.

FIG. 4C illustrates a straightened and aesthetically attractive tassel 100 after having been pressed by the device 200.

Figure 5:
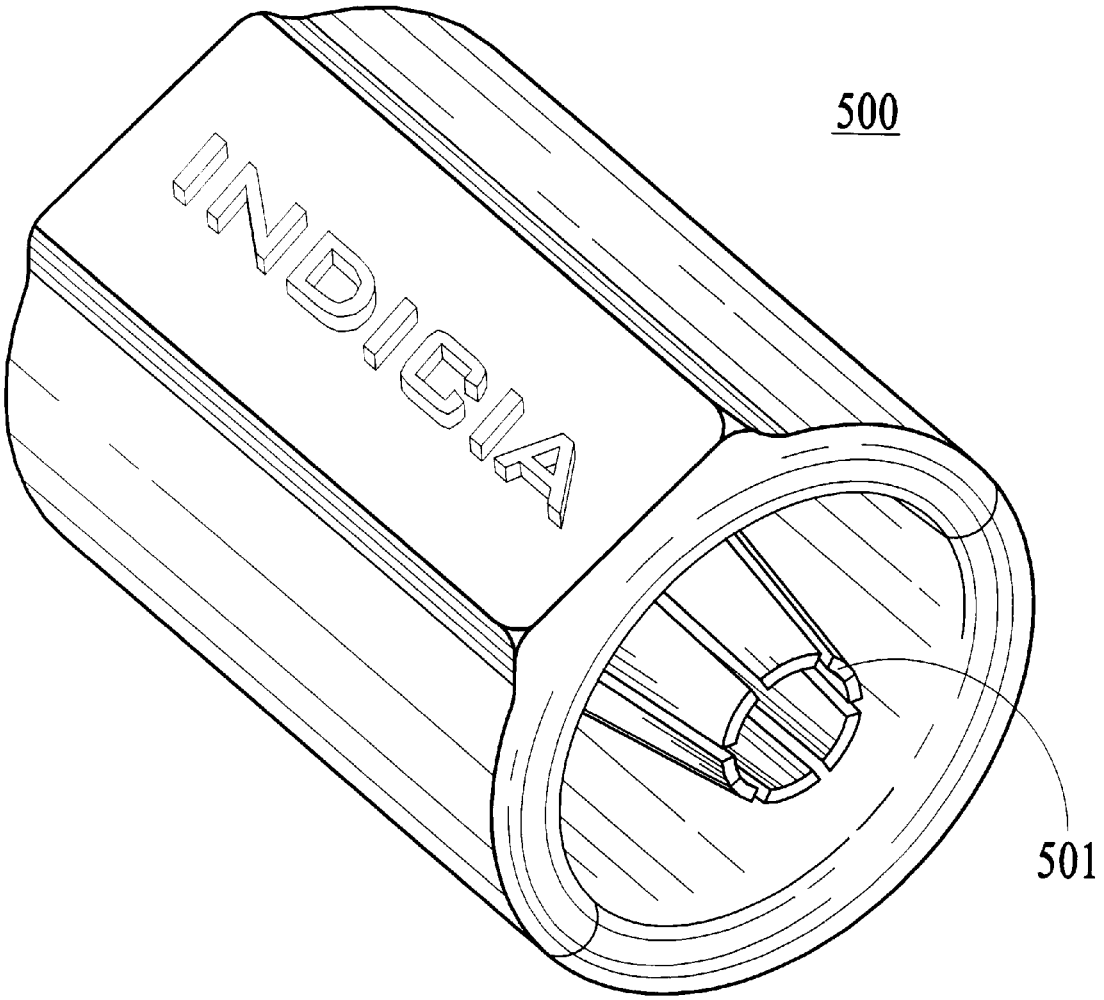
FIG. 5 is a representative view of another preferred embodiment of the tassel device.

FIG. 5 is a representative view of a preferred embodiment of the tassel device 500. The device with an inbuilt flexible collar mold 501 constructed to receive the tassels 100. The flexible mold 501 operates in conjunction with the snap fit mechanism, clamping the tassels 100 housed in it and applying pressure when closed. Because of its conical shape, the flexible mold 501 provides a better fit and greater pressure to straighten the tassel strands 101.

Figure 5A:
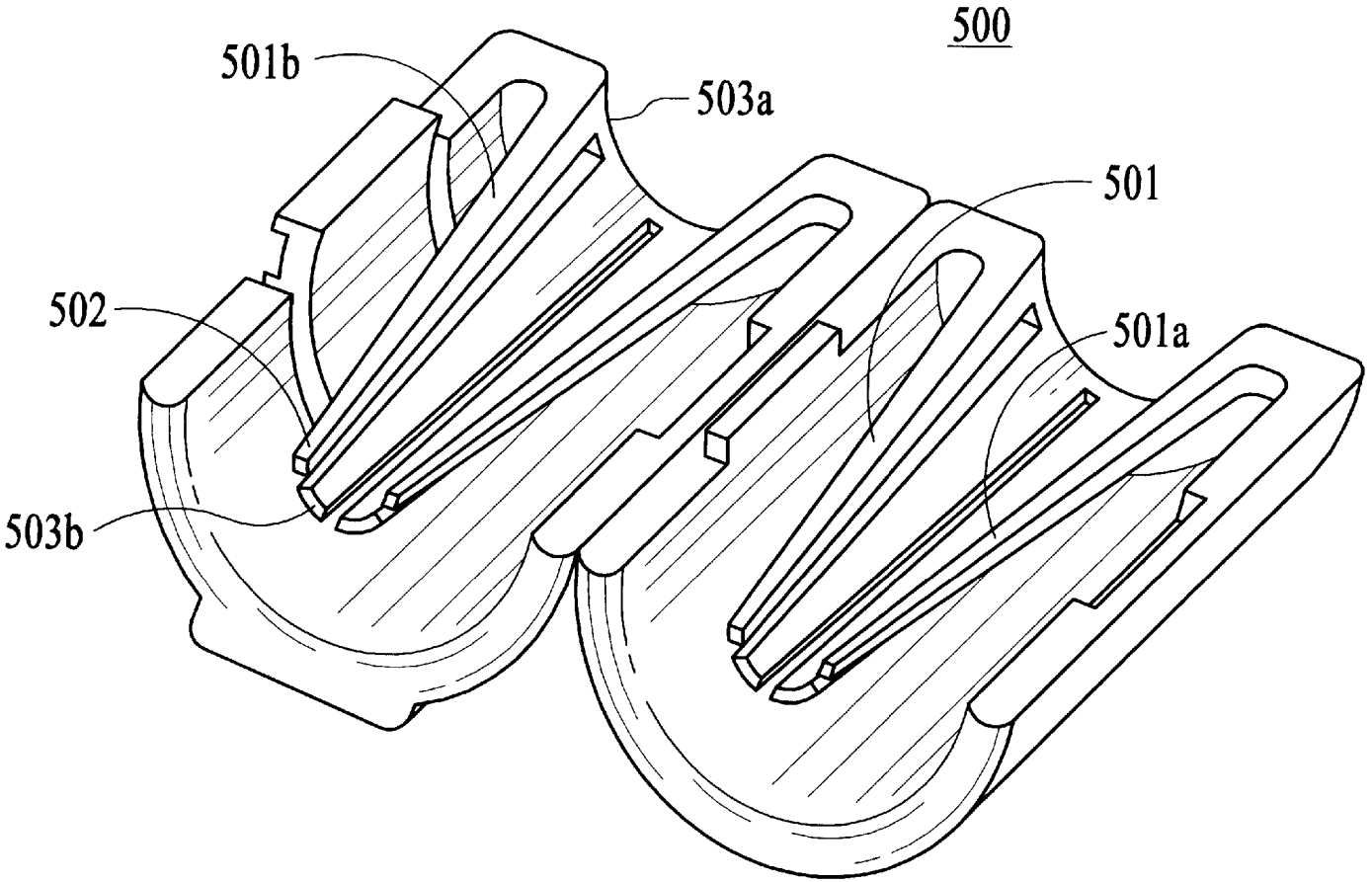
FIG. 5A is a representative view of the tassel device 500 of FIG. 5 in an open position showing the built in mold to receive the tassels.

FIG. 5A is the tassel device 500 shown in FIG. 5A in an open position showing the fingers, tines or prongs 502 of the built-in conical mold 501. The conical mold 501 is shaped as an open ended cone with tines 502 projecting along the length of the tassel device. The conical mold 501 is built-in at one end 503*a* of the tassel device 500 while the conical end 503*b* is free. When the device 500 is opened the conical mold 501 splits into two parts 501*a* and 501*b*. The prongs 502 of the mold 501 are resilient and are designed to accommodate tassels of a variety of sizes and thickness. The tassel 100 is housed in the conical mold 501 and the clamps are snapped to apply pressure. The conical shape of the mold provides greater pressure to straighten and keep straight the tassels.

Figure 6:
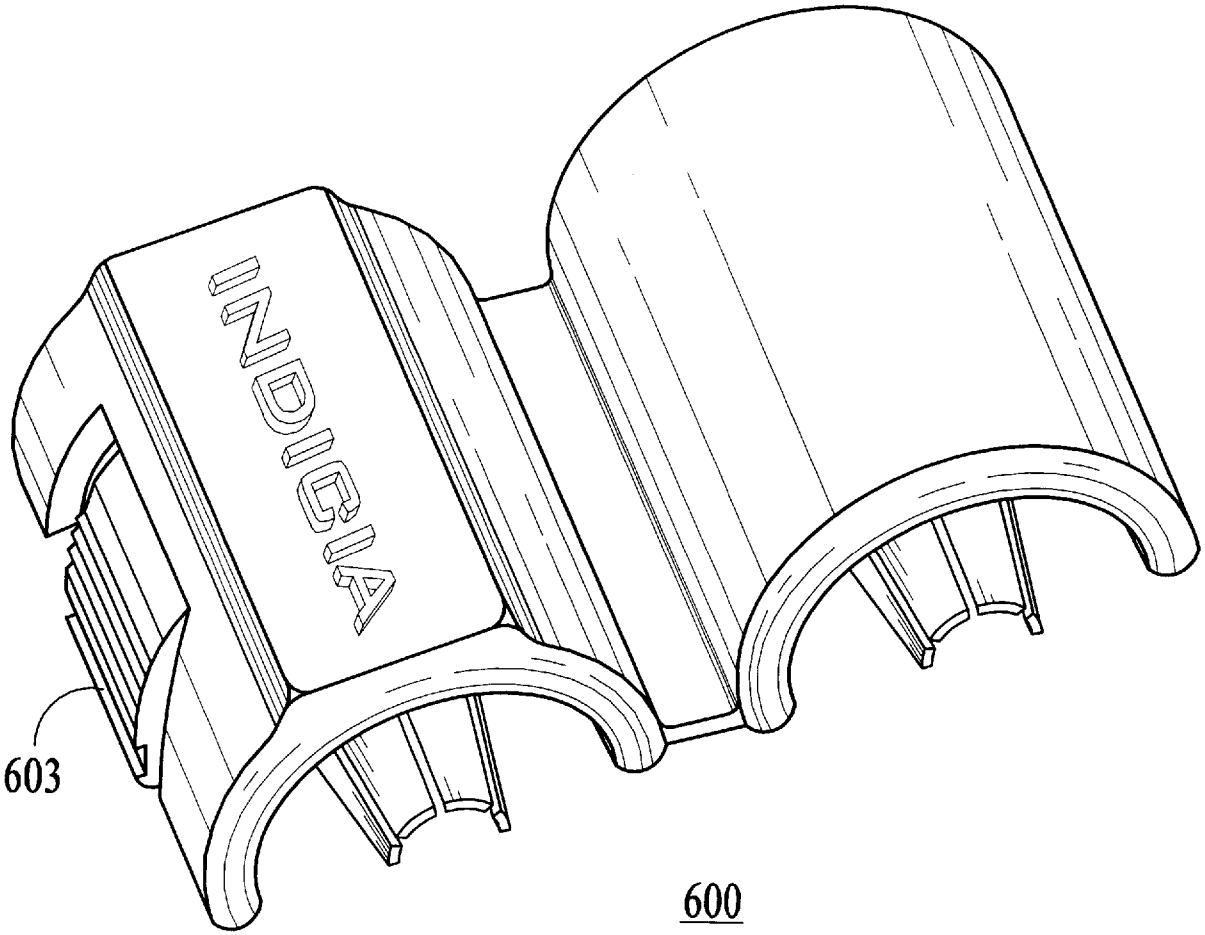
FIG. 6 is a representative perspective view of a preferred embodiment the tassel device showing an alternative clamp.

FIG. 6 is an alternative embodiment of a clamp 604 such as shown in FIG. 2. The clamp 604 in the tassel preserving device 600 is constructed in the middle of the clamshell 205. The clamp 604 locks the tassel strands 101 in the clamshell 205. A snap fit feature secures the locking and presses the tassel strands 101. A release finger 603 is provided to unlock the device 600 tassel strands 101 that are encased in the clamshell 205 for pressing. The clamshell 205 is made up of a number of conventional materials such as plastic, metal, fiberglass or other composite materials.

Figure 6A:
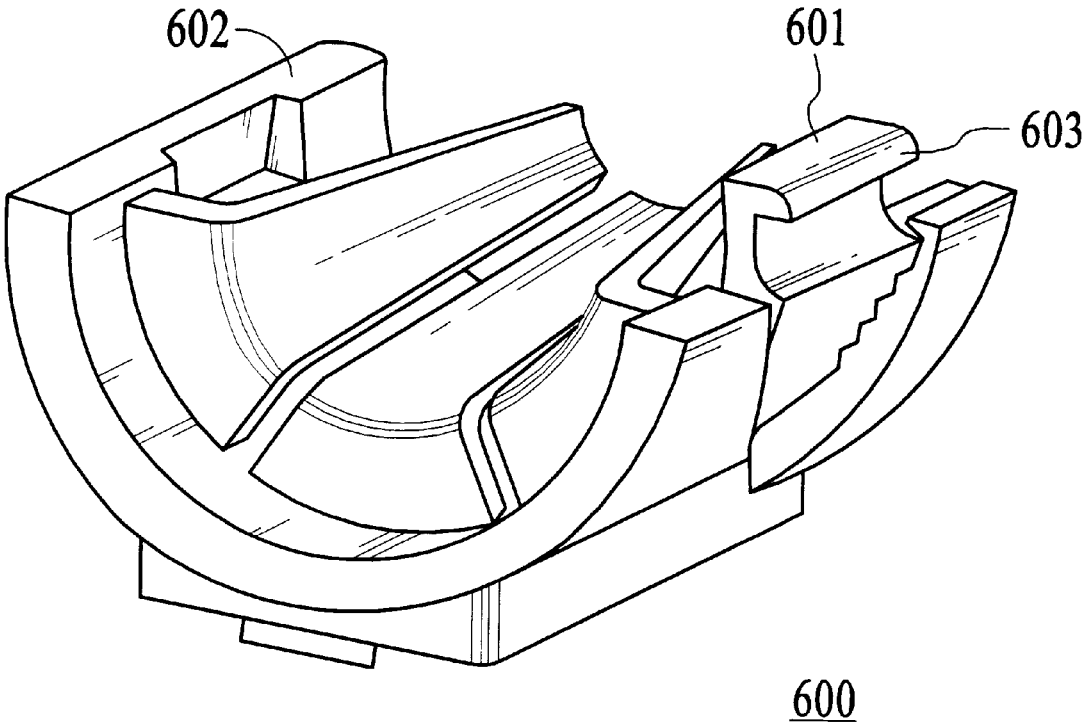
FIG. 6A is a representative perspective view of the clamp of FIG. 6 having an overlying clamping portion projecting out in the middle of the device.

FIG. 6A is the perspective view of the device 600 in an open position showing the clamp 600 projecting from the clamshell 205 in the middle. The clamp operates under the snap-fit action caused by the flexible hinge 202, overlaps the slot 602 and snaps into it when the clamshell 205 is closed.

Unless defined otherwise, all technical and scientific terms used herein have the same meaning as commonly understood by one of ordinary skill in the art to which this invention belongs. Although any methods and materials similar or equivalent to those described can be used in the practice or testing of the present invention, the preferred methods and materials are now described. All publications and patent documents referenced in this application are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A tassel device for preserving and protecting decorative tassels in their original, unfrayed form comprising:

an upper portion and a lower portion configured in an elongated clamshell design;

a hinge means connecting the upper portion with the lower portion; and a clamp means defining a double click lock for locking the upper portion of the clamshell to the lower portion of the clamshell for retaining the tassel strands within in the clamshell design without deforming the original aesthetic appearance of said decorative tassels.

2. The tassel device of claim 1 in which the clamp means comprises a release finger to unlock the upper portion from the lower portion.

3. The tassel device of claim 1 wherein the clamshell is constructed of hard plastic.

4. The tassel device of claim 1 wherein the clamshell is constructed of soft plastic.

5. The tassel device of claim 1 wherein the clamshell is constructed of metal.

6. The tassel device of claim 1 wherein the clamshell is constructed of fiberglass.

7. The tassel device of claim 1 wherein the clamshell is constructed of composite materials.

8. The tassel device of claim 1 wherein the clamshell is constructed in variable thickness.

9. The tassel device of claim 1 wherein the clamshell is constructed in variable lengths according to the intended use.

10. The tassel device of claim 1 wherein the clamp has a triple click lock.

11. The tassel device of claim 1 wherein the clamp has a multiple click lock.

12. The tassel device of claim 1 wherein the hinge is separately constructed.

13. The tassel device of claim 1 wherein the hinge is rigid.

14. The tassel device of claim 1 further comprising one or more elongated, resilient members mounted internally to the clamshell design, to accommodate tassels of a plurality of sizes and thickness.

15. A method of preserving and protecting decorative tassel strands into their original form after they have become disarranged by use of a tassel device to which they are attached, that involves encasing the tassel strands in an elongated clamshell mechanism having a hinge and a clamp means defining a double click lock for pressing the strands between the locked clamshell and thereby reviving them to and maintaining their original aesthetic appearance.

* * * * *